US008583444B2

(12) United States Patent
Lee

(10) Patent No.: US 8,583,444 B2
(45) Date of Patent: Nov. 12, 2013

(54) METHOD AND APPARATUS FOR CANCELING VOCAL SIGNAL FROM AUDIO SIGNAL

(75) Inventor: Jun-ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 320 days.

(21) Appl. No.: 12/902,221

(22) Filed: Oct. 12, 2010

(65) Prior Publication Data

US 2011/0137658 A1 Jun. 9, 2011

(30) Foreign Application Priority Data

Dec. 4, 2009 (KR) ..... 10-2009-0119918

(51) Int. Cl.
*G10L 21/0272* (2013.01)

(52) U.S. Cl.
USPC ..... 704/278

(58) Field of Classification Search
USPC ..... 704/278
See application file for complete search history.

(56) References Cited

U.S. PATENT DOCUMENTS

| | | | | |
|---|---|---|---|---|
| 5,298,674 | A * | 3/1994 | Yun | 84/616 |
| 6,658,112 | B1 * | 12/2003 | Barron et al. | 380/275 |
| 8,090,120 | B2 * | 1/2012 | Seefeldt | 381/104 |
| 2005/0041814 | A1 | 2/2005 | Chen | |
| 2007/0076891 | A1 | 4/2007 | Cho | |

* cited by examiner

*Primary Examiner* — Susan McFadden
(74) *Attorney, Agent, or Firm* — Sughrue Mion, PLLC

(57) ABSTRACT

Provided is a method of canceling a vocal signal, wherein the method includes obtaining a difference signal between two audio signals; and smoothing the frequency of the difference signal. Also provided is a device for canceling a vocal signal, the device including a subtracter which obtains a difference signal between two audio signals; and a frequency smoothing unit which smoothes a frequency of the difference signal.

19 Claims, 4 Drawing Sheets

METHOD AND APPARATUS FOR CANCELING VOCAL SIGNAL FROM AUDIO SIGNAL

CROSS-REFERENCE TO RELATED PATENT APPLICATION

This application claims the benefit of Korean Patent Application No. 10-2009-0119918, filed on Dec. 4, 2009, in the Korean Intellectual Property Office, the disclosure of which is incorporated herein in its entirety by reference.

BACKGROUND

1. Field

The exemplary embodiments relate to a method and apparatus for canceling a vocal signal from an audio signal, and more particularly, to a method and apparatus for canceling a vocal signal from an audio signal by using a frequency smoothing method so as to generate an accompaniment signal having improved sound quality.

2. Description of the Related Art

Due to technological development, users may enjoy music by using various acoustic devices. These acoustic devices provide various functions including not only reproducing music but also providing an audio signal from which a vocal signal is cancelled.

A method of subtracting a signal by using a difference between a left channel signal and a right channel signal is widely used as a method of canceling a vocal signal from an original sound. Such a method is used in that an audio signal may be divided into a vocal signal and an accompaniment signal by musical instruments, wherein the vocal signals included in two channels are similar to each other.

However, a common component of the two channels includes not only the vocal signal but also background music, that is, the accompaniment signal. Thus, if the vocal signal is cancelled by using a signal subtraction method between two channels, the accompaniment signal commonly included in the two channels is also cancelled, in addition to the vocal signal, so that the accompaniment signal is partially damaged.

FIG. 1 is a spectrogram of an accompaniment signal in which a vocal signal is cancelled from an original sound by using a method of subtracting a signal. In FIG. 1, a horizontal axis denotes time, a vertical axis denotes frequency by using the number of samples, and a difference in amplitude of energy according to a change in the axes denotes density. Referring to FIG. 1, a bright part denotes that there is energy and a dark part denotes that there is no energy. In FIG. 1, there are dark parts in various points of the spectrogram of the accompaniment signal which denote that there is no energy. These dark parts represent holes, and non-uniform holes cause distortion such as musical noise. There is a large number of frequency holes in the spectrogram of FIG. 1. Thus, a method and apparatus for removing these frequency holes are required.

SUMMARY

The exemplary embodiments provide a method and apparatus for canceling a vocal signal from an audio signal by which noise generated during canceling of the vocal signal from the audio signal may be removed.

According to an aspect of an exemplary embodiment, there is provided a method of canceling a vocal signal, the method including: obtaining a difference signal between two audio signals; and smoothing the frequency of the difference signal.

The smoothing of the frequency of the difference signal may include: generating input signals of N (N is a positive number greater than or equal to 2) channels by using the difference signal; generating sum signals of the N channels by adding feedback signals of the N channels generated by using a feedback gain matrix to the input signals of the N channels; generating delay signals of the N channels by delaying the sum signals of the N channels using N delay elements; and applying the feedback gain matrix to the delay signals of the N channels.

The method may further include generating the feedback signals of the N channels by multiplying the delay signals of the N channels, to which the feedback matrix is applied, by a gain K (K is a real number less than 1). Also, time delay values of the N delay elements may be coprimes.

The feedback gain matrix may be a Hadamard matrix.

The method may further include generating frequency mono signals by adding the delay signals of the N channels. The method may further include: low pass filtering each of the two audio signals; and adding the mono signals in which frequency is smoothed to the low pass filtered audio signals.

In the low pass filtering of each of the two audio signals, the audio signals may be filtered by using low pass filters having a cutoff frequency of 340 Hz or below.

According to another aspect of an exemplary embodiment, there is provided an apparatus for canceling a vocal signal, the apparatus including: a subtracter for obtaining a difference signal between two audio signals; and a frequency smoothing unit for smoothing the frequency of the difference signal.

According to another aspect of an exemplary embodiment, there is provided a computer readable recording medium having embodied thereon a computer program for executing the method of canceling a vocal signal, the method including: obtaining a difference signal between two audio signals; and smoothing the frequency of the difference signal.

According to an exemplary embodiment, a method and apparatus for efficiently canceling a vocal signal from an audio signal by using a frequency smoothing may be provided.

According to an exemplary embodiment, a method and apparatus for canceling a vocal signal from an audio signal with less operation may be provided.

BRIEF DESCRIPTION OF THE DRAWINGS

The above and other features the exemplary embodiments will become more apparent by describing in detail with reference to the attached drawings in which.

DETAILED DESCRIPTION

Hereinafter, one or more exemplary embodiments will be described more fully with reference to the accompanying drawings.

Figure 2:
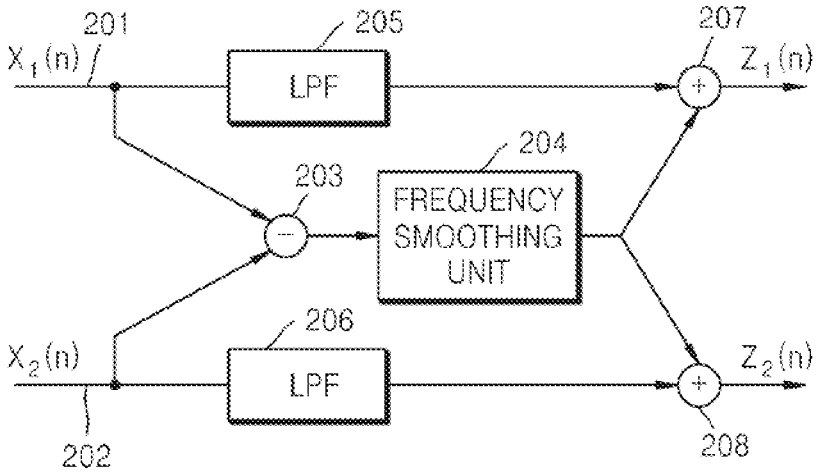
FIG. 2 is a block diagram of an apparatus for canceling a vocal signal, according to an exemplary embodiment.

FIG. 2 is a block diagram of an apparatus 200 for canceling a vocal signal, according to an exemplary embodiment. Referring to FIG. 2, the apparatus 200 for canceling a vocal signal includes audio signal input units 201 and 202, a subtracter 203, a frequency smoothing unit 204, low pass filters (LPFs) 205 and 206, and adders 207 and 208.

The apparatus 200 for canceling a vocal signal may output an audio signal to a user and may be an MP3 player, a PMP, a CD player, a DVD player, and a communication terminal.

The audio signal input units 201 and 202 receive an audio signal from a memory unit (not illustrated) of the apparatus 200 for canceling a vocal signal or from an external server (not illustrated) through a communication network. The audio signal input units 201 and 202 receive an audio signal of two channels including a left channel and a right channel, respectively.

The subtracter 203 obtains a difference signal between two audio signals. The subtracter 203 subtracts the audio signal of the right channel from the audio signal of the left channel or subtracts the audio signal of the left channel from the audio signal of the right channel, thereby generating a difference signal.

Also, the subtracter 203 may obtain an average value of two audio signals and respectively subtract the average value from the two audio signals, thereby generating a difference signal.

The subtracter 203 transmits the generated difference signal to the frequency smoothing unit 204.

The frequency smoothing unit 204 smoothes frequency in order to remove non-uniform holes existing in the difference signal. Smoothing frequency denotes that time-series irregular variation is standardized to redistribute brightness value distribution so as to have uniform distribution. The frequency smoothing unit 204 suppresses an energy change of the difference signal so as to have smooth change overall, thereby standardizing energy fluctuation.

The frequency smoothing unit 204 smoothes the frequency of the difference signal and then transmits the difference signal to both adders 207 and 208.

The LPFs 205 and 206 filter the right channel and the left channel, respectively. The LPFs 205 and 206 extract a signal in a low band from the audio signal in order to extract an accompaniment sound in a low frequency band where a vocal signal does not exist.

In general, a human's voice has a frequency component in the range of about 340 Hz to about 3.4 KHz so that the LPFs 205 and 206 may have a cutoff frequency of 340 Hz or below in the present exemplary embodiment. The LPFs 205 and 206 transmit the filtered audio signal to the adders 207 and 208.

Although not illustrated, the apparatus 200 for canceling a vocal signal may further include a high pass filter in order to extract an accompaniment sound in a high frequency band. In this case, the high pass filter may have a cutoff frequency of 3.4 KHz or greater.

The adders 207 and 208 add the difference signal passing the frequency smoothing unit 204 to the audio signal in a low band filtered by the LPFs 205 and 206 and newly generate two audio signals from which a vocal signal is cancelled.

If the high pass filter is further included in FIG. 2, the adders 207 and 208 may add the audio signal in a high band filtered by the high pass filter when the audio signal is generated.

According to the exemplary embodiment, the frequency smoothing method is used to smooth the frequency of the difference signal so that an accompaniment signal having uniform distribution may be generated.

Figure 3:
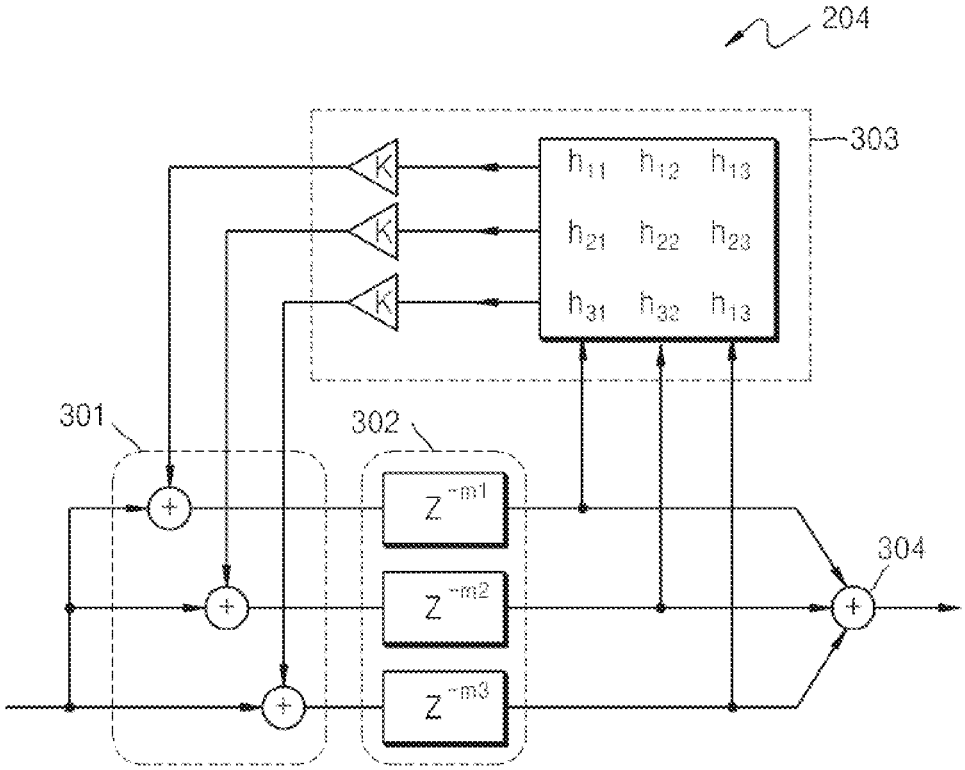
FIG. 3 is a block diagram of a frequency smoothing unit of FIG. 2.

FIG. 3 is a block diagram of the frequency smoothing unit 204 of FIG. 2. Referring to FIG. 3, the frequency smoothing unit 204 includes a sum signal generating unit 301, a delay signal generating unit 302, a feedback signal generating unit 303, and an output signal generating unit 304.

The frequency smoothing unit 204 uses the difference signal generated by the subtracter 203 of FIG. 2 as input signals of N channels. That is, the input signals of N channels are the same as each other. Here, N is a positive number greater than or equal to 2. In FIG. 3, N is 3.

The sum signal generating unit 301 generates sum signals for each of N channels by adding feedback signals of N channels feedback from the feedback signal generating unit 303 to the input signals of N channels. The sum signal generating unit 301 transmits the sum signals to the delay signal generating unit 302.

The delay signal generating unit 302 delays the sum signals of N channels by using N delay elements. The N delay elements each have a different delay time value and the delay time values may not be in multiple proportion. That is, the delay time values of the delay elements may be coprimes which do not have a common factor. If the delay time values of the delay elements are in multiple proportion when the frequency smoothing unit 204 repeatedly performs feedback, each delay time value is added so as to increase a mono signal value generated from the output signal generating unit 304.

The feedback signal generating unit 303 applies a feedback gain matrix to the delay signals of N channels generated by the delay signal generating unit 302 and performs frequency smoothing. The feedback gain matrix preserves energy of each channel and mixes the delay signals of each channel.

The feedback signal generating unit 303 may use an orthogonal matrix as the feedback gain matrix. The orthogonal matrix indicates a matrix which becomes an identity matrix when the matrix is multiplied by a transpose matrix of the matrix. Also, the feedback signal generating unit 303 may use an Nth Hadamard matrix as the feedback gain matrix. The Nth Hadamard matrix, which is a square matrix having a size of N*N, is only formed of +1 and −1 elements and is an N times identity matrix when the matrix is multiplied by the transpose matrix of the matrix.

The feedback signal generating unit 303 generates the feedback signals of N channels by multiplying a gain K by the delay signals to which the feedback gain matrix is applied. Here, the gain K may be a real number less than 1 so as to converge the mono signal value generated by the output signal generating unit 304, as will be described later with reference to Table 1.

The feedback signal generating unit 303 feedbacks the feedback signals of N channels to the sum signal generating unit 301.

The sum signal generating unit 301 adds the feedback signals generated by the feedback signal generating unit 303 to the input signals and transmits the added signals to the delay signal generating unit 302.

The frequency smoothing unit 204 repeatedly performs the above process.

The output signal generating unit 304 generates mono signal by adding the delay signals of N channels generated by the delay signal generating unit 302. The mono signal generated by the output signal generating unit 304 is added to the signals passing the LPFs 205 and 206 by the adders 207 and 208.

Convergence of the mono signal values generated by the frequency smoothing unit 204 of FIG. 3 is described with reference to Table 1 below.

For convenience of description, it is assumed that N is 2 in FIG. 3. Also, it is assumed that the input signals are 1 only at time 0 and are 0 at the remaining times. In addition, it is assumed that the time delay value of the delay elements is 2 for a first channel and 3 for a second channel. It is assumed that the feedback gain matrix used in the feedback signal generating unit 303 is a 2*2 Hadamard matrix of $$\begin{bmatrix} 1 & 1 \\ 1 & -1 \end{bmatrix}.$$

TABLE 1

| Time | Input signal value | Sum signal value (output of sum signal generating unit 301) | Delay element | Delay signal value (output of delay signal generating unit 302) | Feedback signal value (output of feedback signal generating unit 303) | Mono signal value (output of output signal generating unit 304) |
|---|---|---|---|---|---|---|
| 0 | 1 | $\begin{bmatrix}1\\1\end{bmatrix}$ | [1, 0]<br>[1, 0, 0] | $\begin{bmatrix}0\\0\end{bmatrix}$ | $\begin{bmatrix}0\\0\end{bmatrix}$ | 0 |
| 1 | 0 | $\begin{bmatrix}0\\0\end{bmatrix}$ | [0, 1]<br>[0, 1, 0] | $\begin{bmatrix}0\\0\end{bmatrix}$ | $\begin{bmatrix}0\\0\end{bmatrix}$ | 0 |
| 2 | 0 | $\begin{bmatrix}0\\0\end{bmatrix}$ | [0, 0]<br>[0, 0, 1] | $\begin{bmatrix}1\\0\end{bmatrix}$ | $\begin{bmatrix}K\\K\end{bmatrix}$ | 1 |
| 3 | 0 | $\begin{bmatrix}K\\K\end{bmatrix}$ | [K, 0]<br>[K, 0, 0] | $\begin{bmatrix}0\\1\end{bmatrix}$ | $\begin{bmatrix}K\\-K\end{bmatrix}$ | 1 |
| 4 | 0 | $\begin{bmatrix}K\\-K\end{bmatrix}$ | [K, K]<br>[−K, K, 0] | $\begin{bmatrix}0\\0\end{bmatrix}$ | $\begin{bmatrix}0\\0\end{bmatrix}$ | 0 |
| 5 | 0 | $\begin{bmatrix}0\\0\end{bmatrix}$ | [0, K]<br>[0, −K, K] | $\begin{bmatrix}K\\0\end{bmatrix}$ | $\begin{bmatrix}K\wedge 2\\K\wedge 2\end{bmatrix}$ | K |
| 6 | 0 | $\begin{bmatrix}K\wedge 2\\K\wedge 2\end{bmatrix}$ | [K ^ 2, 0]<br>[K ^ 2, 0, −K] | $\begin{bmatrix}K\\K\end{bmatrix}$ | $\begin{bmatrix}2K\wedge 2\\0\end{bmatrix}$ | 2K |
| 7 | 0 | $\begin{bmatrix}2K\wedge 2\\0\end{bmatrix}$ | [2K ^ 2, K ^ 2]<br>[0, K ^ 2, 0] | $\begin{bmatrix}0\\-K\end{bmatrix}$ | $\begin{bmatrix}-K\wedge 2\\K\wedge 2\end{bmatrix}$ | −K |
| 8 | 0 | $\begin{bmatrix}-K\wedge 2\\K\wedge 2\end{bmatrix}$ | [−K ^ 2, 2K ^ 2]<br>[K ^ 2, 0, K ^ 2] | $\begin{bmatrix}K\wedge 2\\0\end{bmatrix}$ | $\begin{bmatrix}K\wedge 3\\K\wedge 3\end{bmatrix}$ | K ^ 2 |
| 9 | 0 | $\begin{bmatrix}K\wedge 3\\K\wedge 3\end{bmatrix}$ | [K ^ 3, −K ^ 2]<br>[K ^ 3, K ^ 2, 0] | $\begin{bmatrix}2K\wedge 2\\K\wedge 2\end{bmatrix}$ | $\begin{bmatrix}3K\wedge 2\\K\wedge 2\end{bmatrix}$ | 3K ^ 2 |

Referring to Table 1, input signal 1 is respectively input to two channels at time 0. As the feedback gain signal value is 0, a value of the signal passing the sum signal generating unit 301 is also 1. The delay signal generating unit 302 delays two input signals by time 2 for the first channel and time 3 for the second channel.

For convenience of description, if it is considered that the delay element is a buffer, the delay element for one of the two channels stores the input signal value 1 to the buffer and outputs the stored input signal value 1 at the point after time 2 passes from the current time. Also, the delay element for the remaining channel stores the input signal value 1 to the buffer and outputs the stored input signal value 1 at the point after time 3 passes from the current time.

In a column for "delay element" in Table 1, two channels are respectively represented as brackets, wherein the first channel is located above and the second channel is located below. In each bracket, an input signal value is represented at the left and the input signal value moves to the right when the time passes by 1. That is, when it is considered that the bracket represented in the "delay element" in Table 1 is a buffer, the buffer stores the input signal value at the current time to the left, moves the value stored at the left to the right when the time passes by 1, and outputs the value when the value is not moved more. As the time delay value for the first channel is 2 and the time delay value for the second channel is 3, both brackets in the "delay element" in Table 1 are represented as brackets having 2 and 3 elements, respectively.

When the time is 0, the delay signal values passing the delay signal generating unit 302 are 0 in both channels. The output signal generating unit 304 adds the delay signal values of both channels, thereby generating one signal value. When the time is 0, the delay signal values of both channels are 0 and thus the mono signal value generated by the output signal generating unit 304 is also 0.

When the delay signal value of both channels is represented as a 2*1 vector $$\begin{bmatrix}0\\0\end{bmatrix},$$

the feedback signal generating unit 303 multiplies a feedback gain matrix $$\begin{bmatrix}1 & 1\\1 & -1\end{bmatrix}$$

and a vector $$\begin{bmatrix} 0 \\ 0 \end{bmatrix}$$

that represents the delay signal value and multiplies the resultant by a gain K, thereby generating the feedback signal. In Table 1, the feedback signal value is a $$\begin{bmatrix} 0 \\ 0 \end{bmatrix}$$

vector.

The feedback signal is added to the input signal value in the sum signal generating unit 301 at the point of time of 1.

The input signal value is 0 when the time is 1, and the signal passing the sum signal generating unit 301 is also $$\begin{bmatrix} 0 \\ 0 \end{bmatrix}.$$

In the delay element, the input signal value is represented at the left of each bracket when the time is 1 and a previous input signal value is moved by one to the right. Since there is no value output to the buffer yet, the delay signal value passing the delay signal generating unit 302 is 0 in both channels when the time is 1 and thus the delay signal value is represented as $$\begin{bmatrix} 0 \\ 0 \end{bmatrix}.$$

The feedback signal generating unit 303 multiplies the vector of the delay signal value $$\begin{bmatrix} 0 \\ 0 \end{bmatrix}$$

by the feedback gain matrix and multiplies the resultant by the gain K, thereby generating the feedback gain signal $$\begin{bmatrix} 0 \\ 0 \end{bmatrix}.$$

The feedback gain signal is added to the input signal value in the sum signal generating unit 301 at the point of time of 2.

The output signal generating unit 304 adds the delay signal values of both channels together, thereby generating one signal value. When the time is 1, the delay signals of both channels are 0 and thus the mono signal value generated by the output signal generating unit 304 is also 0.

Since the input signal value is 0 when the time is 2, the signal passing the sum signal generating unit 301 is also $$\begin{bmatrix} 0 \\ 0 \end{bmatrix}.$$

In the delay element, the input signal value is represented at the left of each bracket when the time is 2 and a previous input signal value 0 is moved by one to the right. The delay element for the first channel from among the two channels represents the input signal at the point of time of 2 at the left of the buffer so that the signal value 1 located at the right and the is pushed out to the buffer so as to be an output signal of the delay signal generating unit 302 for the first channel. That is, the delay signal value passing the delay element when the time is 2 is represented as a vector of $$\begin{bmatrix} 1 \\ 0 \end{bmatrix}.$$

The feedback signal generating unit 303 multiplies a vector of the delay signal $$\begin{bmatrix} 1 \\ 0 \end{bmatrix}$$

by the feedback gain matrix so as to generate a $$\begin{bmatrix} 1 \\ 1 \end{bmatrix}$$

vector and multiples the $$\begin{bmatrix} 1 \\ 1 \end{bmatrix}$$

vector by the gain K, thereby generating the feedback signal $$\begin{bmatrix} K \\ K \end{bmatrix}.$$

The feedback signal is added again to the input signal value in the sum signal generating unit 301 at the point of time of 3.

The output signal generating unit 304 adds the delay signal values of both channels together, thereby generating one signal value. When the time is 2, the delay signal values of both channels are respectively 1 and 0 and thus the mono signal value generated by the output signal generating unit 304 is 1. As illustrated in Table 1, if these processes are repeatedly performed, the mono signal value generated by the output signal generating unit 304 is represented as a value obtained by multiplying a positive number by exponent of K such as K, K^2, or K^3. K is a gain value less than 1. Thus, as an exponent increases, the mono signal value is exponentially reduced and is finally 0, which denotes that the frequency of the difference signal is smoothed.

Figure 1:
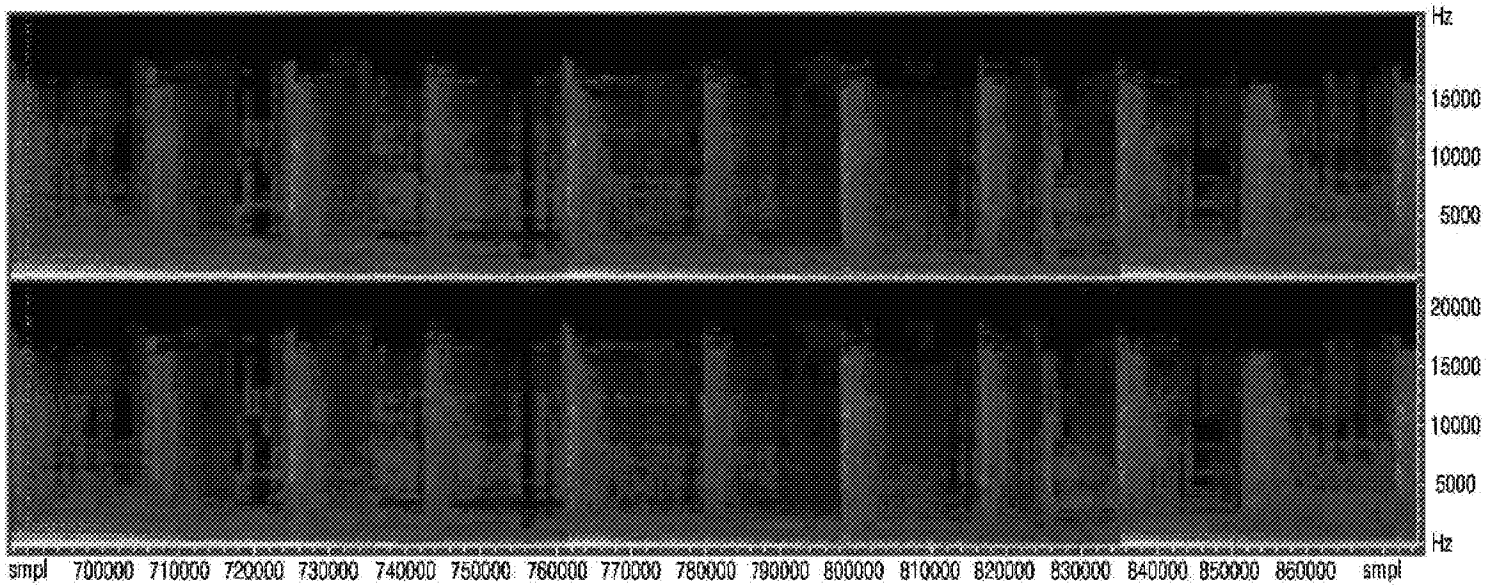
FIG. 1 is a spectrogram of an accompaniment signal in which a vocal signal is cancelled from an original sound by using a method of subtracting a signal.
Figure 4:
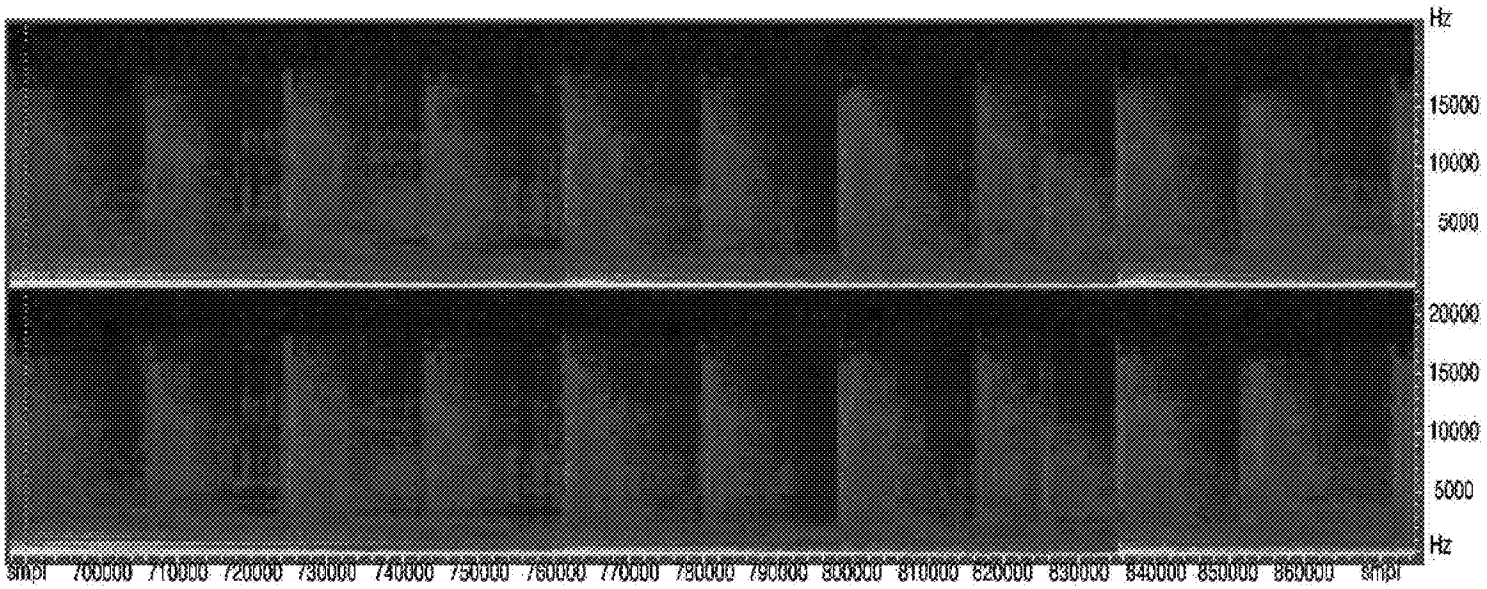
FIG. 4 is a spectrogram of an accompaniment signal in which a vocal signal is cancelled from an original sound, according to an exemplary embodiment.

FIG. 4 is a spectrogram of an accompaniment signal in which a vocal signal is cancelled from an original sound, according to an exemplary embodiment. In the spectrogram of FIG. 4, a horizontal axis denotes time, a vertical axis denotes frequency, and a difference in amplitude of energy according to a change of the axes denotes density. Unlike FIG. 1, non-uniform holes, which are dark because of no energy, located in various places of the accompaniment signal are removed in FIG. 4. That is, energy is uniformly distributed.

Figure 5:
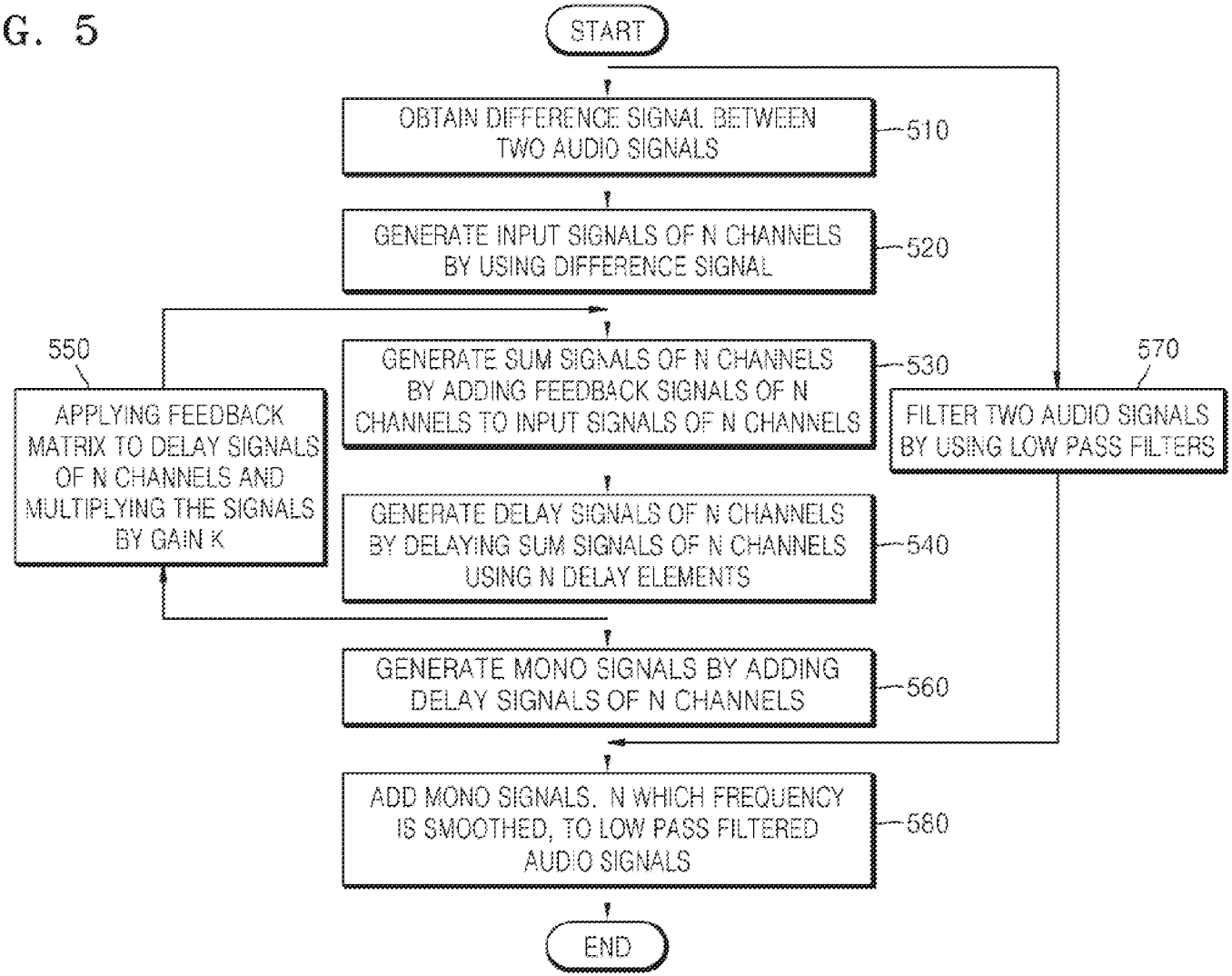
FIG. 5 is a flowchart illustrating a method of canceling a vocal signal, according to an exemplary embodiment.

FIG. 5 is a flowchart illustrating a method of canceling a vocal signal, according to an exemplary embodiment. Referring to FIG. 5, the apparatus 200 for canceling a vocal signal filters two audio signals by using low pass filters, in operation 570. For example, the apparatus 200 for canceling a vocal signal may filter the audio signal by using low pass filters having a cutoff frequency of 340 Hz or below.

Also, the apparatus 200 for canceling a vocal signal obtains a difference signal between the two audio signals, in operation 510. In operation 520, the apparatus 200 for canceling a vocal signal generates input signals of N (N is a positive number greater than or equal to 2) channels.

In operation 530, the apparatus 200 for canceling a vocal signal adds feedback signals of N channels generated by applying a feedback gain matrix to the input signals of N channels and generates sum signals of N channels. In operation 540, the apparatus 200 for canceling a vocal signal delays the sum signals of N channels by using N delay elements and generates delay signals of N channels. Here, time delay values of N delay elements may be coprimes.

In operation 550, the apparatus 200 for canceling a vocal signal applies a feedback matrix to the delay signals of N channels and multiplies the signals, to which the feedback matrix is applied, by the gain K (K is a real number less than 1), thereby generating feedback gain signals. The feedback gain matrix may be an orthogonal matrix or a Hadamard matrix.

In operation 530, the apparatus 200 for canceling a vocal signal adds again the feedback gain signals to the input signals. The apparatus 200 for canceling a vocal signal repeatedly performs such processes.

The apparatus 200 for canceling a vocal signal generates frequency mono signals by adding the delay signals of N channels, in operation 560 and adds frequency mono signals, in which the frequency is smoothed, to the low pass filtered audio signals, thereby generating audio signals in which a vocal signal is cancelled, in operation 580.

According to the exemplary embodiments, a vocal signal may be efficiently cancelled from audio signals with algorithms having low complexity and less operation. That is, as complexity is low, the exemplary embodiments may be easily applied to mobile terminals or MP3.

The method and apparatus for canceling a vocal signal can be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of canceling a vocal signal in a terminal device, the method comprising:

obtaining, by the terminal device, a difference signal between two audio signals; and smoothing a frequency of the difference signal.

2. The method of claim 1, wherein the smoothing of the frequency of the difference signal comprises:

generating input signals of N channels by using the difference signal, N being a positive number greater than or equal to 2;

adding feedback signals of the N channels generated by using a feedback gain matrix to the input signals of the N channels, to generate sum signals of the N channels;

delaying the sum signals of the N channels using N delay elements to generate delay signals of the N channels; and applying the feedback gain matrix to the delay signals of the N channels.

3. The method of claim 2, further comprising multiplying the delay signals of the N channels, to which the feedback matrix is applied, by a gain K to generate the feedback signals of the N channels, K being a real number less than 1.

4. The method of claim 2, wherein time delay values of the N delay elements are coprimes.

5. The method of claim 2, wherein the feedback gain matrix is a Hadamard matrix.

6. The method of claim 2, wherein the feedback gain matrix is an orthogonal matrix.

7. The method of claim 2, further comprising generating frequency mono signals by adding the delay signals of the N channels.

8. The method of claim 7, further comprising:

low pass filtering the two audio signals; and adding the frequency mono signals in which the frequency is smoothed to the low pass filtered two audio signals.

9. The method of claim 8, wherein in the low pass filtering of the two audio signals, the two audio signals are filtered by using low pass filters having a cutoff frequency of 340 Hz or below.

10. An apparatus for canceling a vocal signal, the apparatus comprising:

a subtracter which obtains a difference signal between two audio signals; and a frequency smoothing unit which smoothes a frequency of the difference signal, wherein the subtracter is implemented as hardware.

11. The apparatus of claim 10, wherein the frequency smoothing unit comprises:

a sum signal generating unit which adds feedback signals of N channels to input signals of N channels generated by using the difference signal to generate sum signals of N channels, N being a positive number greater than or equal to 2;

a delay signal generating unit delays the sum signals of the N channels using N delay elements to generate delay signals of the N channels; and a feedback signal generating unit which applies a feedback gain matrix to the delay signals of the N channels.

12. The apparatus of claim 11, wherein the feedback signal generating unit generates which multiplies the delay signals of the N channels, to which the feedback matrix is applied, by a gain K to generate the feedback signals of the N channels, K being a real number less than 1.

13. The apparatus of claim 11, wherein time delay values of the N delay elements are coprimes.

14. The apparatus of claim 11, wherein the feedback gain matrix is a Hadamard matrix.

15. The apparatus of claim 11, wherein the feedback gain matrix is an orthogonal matrix.

16. The apparatus of claim 11, wherein the frequency smoothing unit further comprises an output signal generating unit which generates frequency mono signals by adding the delay signals of the N channels.

17. The apparatus of claim 16, further comprising:

a low pass filter (LPF) which filters two audio signals; and two adders which generate audio signals in which a vocal signal is cancelled by adding mono signals in which the frequency is smoothed to the low pass filtered two audio signals.

18. The apparatus of claim 17, wherein the LPF has a cutoff frequency of 340 Hz or below.

19. A non-transitory computer readable recording medium having embodied thereon a computer program for executing a method of canceling a vocal signal in a terminal device, the method comprising:

obtaining, by the terminal device, a difference signal between two audio signals; and smoothing a frequency of the difference signal.

* * * * *